US011603805B1

(12) United States Patent
Dudar et al.

(10) Patent No.: US 11,603,805 B1
(45) Date of Patent: Mar. 14, 2023

(54) SYSTEMS AND METHODS FOR EVAPORATIVE EMISSIONS CONTROL

(71) Applicant: Ford Global Technologies, LLC, Dearborn, MI (US)

(72) Inventors: Aed Dudar, Canton, MI (US); Finn Tseng, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/453,549

(22) Filed: Nov. 4, 2021

(51) Int. Cl.
*F02D 41/00* (2006.01)
*F02M 35/10* (2006.01)
*F02M 25/08* (2006.01)

(52) U.S. Cl.
CPC ..... *F02D 41/0032* (2013.01); *F02M 25/0836* (2013.01); *F02M 35/10222* (2013.01); *F02D 2200/0406* (2013.01); *F02D 2200/702* (2013.01)

(58) Field of Classification Search
CPC ..... F02D 41/0032; F02D 2200/0406; F02D 2200/702; F02M 25/0836; F02M 35/10222
See application file for complete search history.

(56) References Cited

U.S. PATENT DOCUMENTS

| | | | | |
|---|---|---|---|---|
| 9,677,512 | B2 | 6/2017 | Dudar et al. | |
| 10,550,776 | B1 * | 2/2020 | Leone | B60K 15/03519 |
| 10,718,282 | B2 | 7/2020 | Dudar | |
| 10,907,563 | B2 | 2/2021 | Dudar | |
| 2014/0277927 | A1 * | 9/2014 | Guo | F02M 25/0818 701/34.4 |
| 2015/0122228 | A1 * | 5/2015 | Bolger | F02D 41/004 123/518 |
| 2016/0312718 | A1 * | 10/2016 | Dudar | F02D 41/021 |
| 2017/0130659 | A1 * | 5/2017 | Dudar | F02M 25/0836 |
| 2017/0350351 | A1 * | 12/2017 | Lucka | G01M 3/26 |
| 2018/0073448 | A1 * | 3/2018 | Dudar | F02D 41/221 |
| 2019/0107081 | A1 * | 4/2019 | Dudar | F02D 41/0037 |
| 2020/0102904 | A1 * | 4/2020 | Dudar | F02D 41/22 |
| 2020/0149483 | A1 * | 5/2020 | Dudar | F02M 25/0836 |
| 2022/0120245 | A1 * | 4/2022 | Dudar | F02M 25/0836 |

* cited by examiner

*Primary Examiner* — Xiao En Mo
(74) *Attorney, Agent, or Firm* — Vincent Mastrogiacomo; McCoy Russell LLP

(57) ABSTRACT

Methods and systems are provided for reducing a possibility of hydrocarbon (HC) release to atmosphere from an evaporative emissions control (EVAP) system. In one example, a method may include, isolating a fuel vapor canister of the EVAP system from atmosphere and an engine intake manifold upon conditions being met for a potential hydrocarbon (HC) breakthrough from the fuel vapor canister.

18 Claims, 5 Drawing Sheets

SYSTEMS AND METHODS FOR EVAPORATIVE EMISSIONS CONTROL

FIELD

The present description relates generally to methods and systems for reducing a possibility of hydrocarbon (HC) release to atmosphere from an evaporative emissions control (EVAP) system.

BACKGROUND/SUMMARY

Vehicle emission control systems may be configured to store refueling vapors, running-loss vapors, and diurnal emissions in a fuel vapor canister, and then purge the stored vapors during a subsequent engine operation. The stored vapors may be routed to engine intake for combustion, further improving fuel economy for the vehicle. In a typical canister purge operation, a canister purge valve coupled between the engine intake and the fuel vapor canister is opened, allowing for intake manifold vacuum to be applied to the fuel vapor canister. Fresh air may be drawn through the fuel vapor canister via an open canister vent valve. This configuration facilitates desorption of stored fuel vapors from the adsorbent material in the canister, regenerating the adsorbent material for further fuel vapor adsorption. In hybrid vehicles, and other vehicles configured to operate in engine-off or reduced manifold vacuum modes, opportunities to purge the fuel vapor canister to the intake of the engine may be infrequent.

One approach for addressing a potential HC breakthrough from a canister to a vent line of the EVAP system is described by Dudar et al. in U.S. Pat. No. 9,677,512. Therein, during a diagnostic test of the EVAP system including generating a vacuum on a fuel vapor canister via a dedicated pump, responsive to the EVAP pressure reaching a plateau or inflection point prior to reaching a reference threshold, the vacuum generation is suspended and the diagnostic test is discontinued to reduce the possibility of HC breakthrough from the canister. The diagnostic test may be restarted upon a set of conditions including purge flow summation being higher than a threshold being met.

However, the inventors herein have recognized potential issues with such systems. As one example, the HC breakthrough to the vent line, as detected by the HC sensor, may be released to the atmosphere, thereby adversely affecting emissions quality. During certain vehicle operating conditions such as when the vehicle is operated with motor torque or when the vehicle is operated at intake manifold pressure closer to atmospheric pressure (intake vacuum not available), it may not be possible to purge the canister and reduce the HC load in the canister. Adjusting engine operation to enable purging may result in reduction in fuel efficiency. If the load in the canister cannot be reduced, the potential of breakthrough of HCs from the canister may increase during certain drive conditions such as during increased road roughness when the HCs are desorbed from the canister. Further, the potential of breakthrough of HCs from the canister may also increase during conditions when the vehicle is exposed to sun for a prolonged duration with the fuel tank housing a large amount of fuel (which may vaporize in the heat). HC entering the vent line from the canister may be released to the atmosphere which may be detrimental for maintaining emissions standards.

In one example, the issues described above may be addressed by a method for an engine, comprising: in response to conditions being met for a potential hydrocarbon (HC) breakthrough from a fuel vapor canister of an evaporative emissions control (EVAP) system, isolating the canister from atmosphere and an intake manifold of the engine. In this way, by opportunistically isolating the EVAP system from the atmosphere, the potential of HC release to the atmosphere may be reduced.

As one example, road roughness conditions may be estimated based on outputs from a yaw rate sensor, a crankshaft acceleration sensor, wheel speed sensor, and a navigational device. Further, fuel level in the fuel tank and a HC loading in the canister may be estimated. In response to a higher than threshold rough road conditions and a higher than threshold canister loading, a mitigation method may be initiated. If the engine is operating with intake vacuum, then the canister may be purged. If the engine is not operating with engine intake vacuum such as based on settings of a variable compression timing (VCT) mechanism or when the vehicle is operating solely via motor torque, the mitigation method may include closing a canister vent valve (CVV) while a canister purge valve (CPV) is maintained in a closed position to isolate the EVAP system from atmosphere and engine intake manifold. The pressure in the EVAP system may be monitored during the isolation. In response to the pressure increasing to a threshold pressure, the CPV may be opened while maintaining the CVV closed. Upon release of the pressure, the CPV may be actuated back to the closed position. Upon an immediate availability of engine vacuum, the CVV and the CPV may be opened to purge the EVAP system.

In this way, by opportunistically isolating the EVAP system from atmosphere during conditions of increased HC breakthrough possibility, release of HC to atmosphere may be prevented. By preventing the release of HC to the atmosphere without adjusting engine operation, emissions quality may be maintained. By releasing the pressure of the EVAP system without venting the EVAP system, integrity of the system may be maintained and possibility of mechanical wear may be reduced. The technical effect of monitoring road roughness conditions during a drive cycle is that it may be possible to identify portions of the drive cycle where volatilization of liquid fuel may increase due to fuel sloshing or HC may desorb from the canister due to vibrations, thereby increasing possibility of HC breakthrough. Overall, by effectively reducing the possibility of HC release to the atmosphere during all vehicle operating conditions, emissions quality may be maintained above desired levels.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 3:
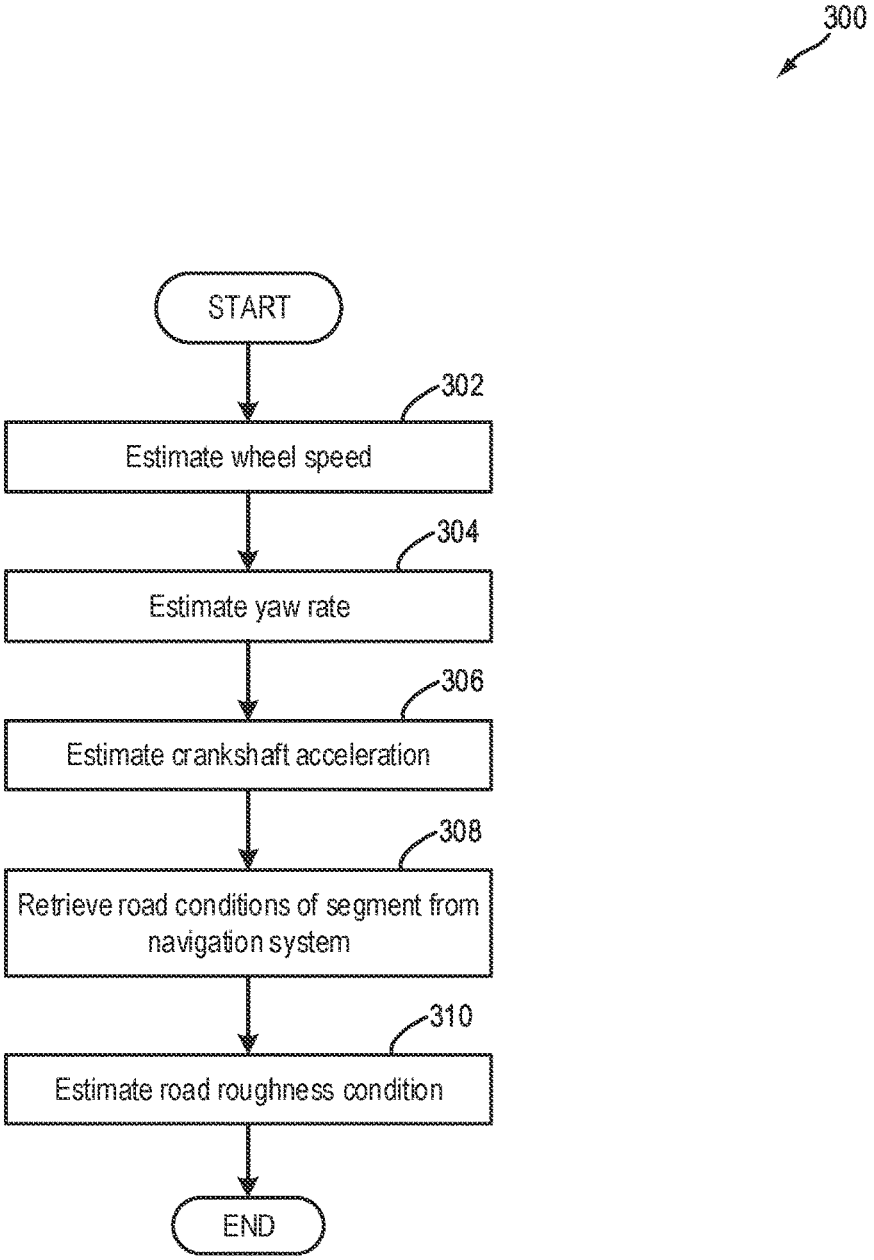
FIG. 3 shows a first flow-chart of a method for determining roughness of a road on which the vehicle is operating during a drive cycle.
Figure 4:
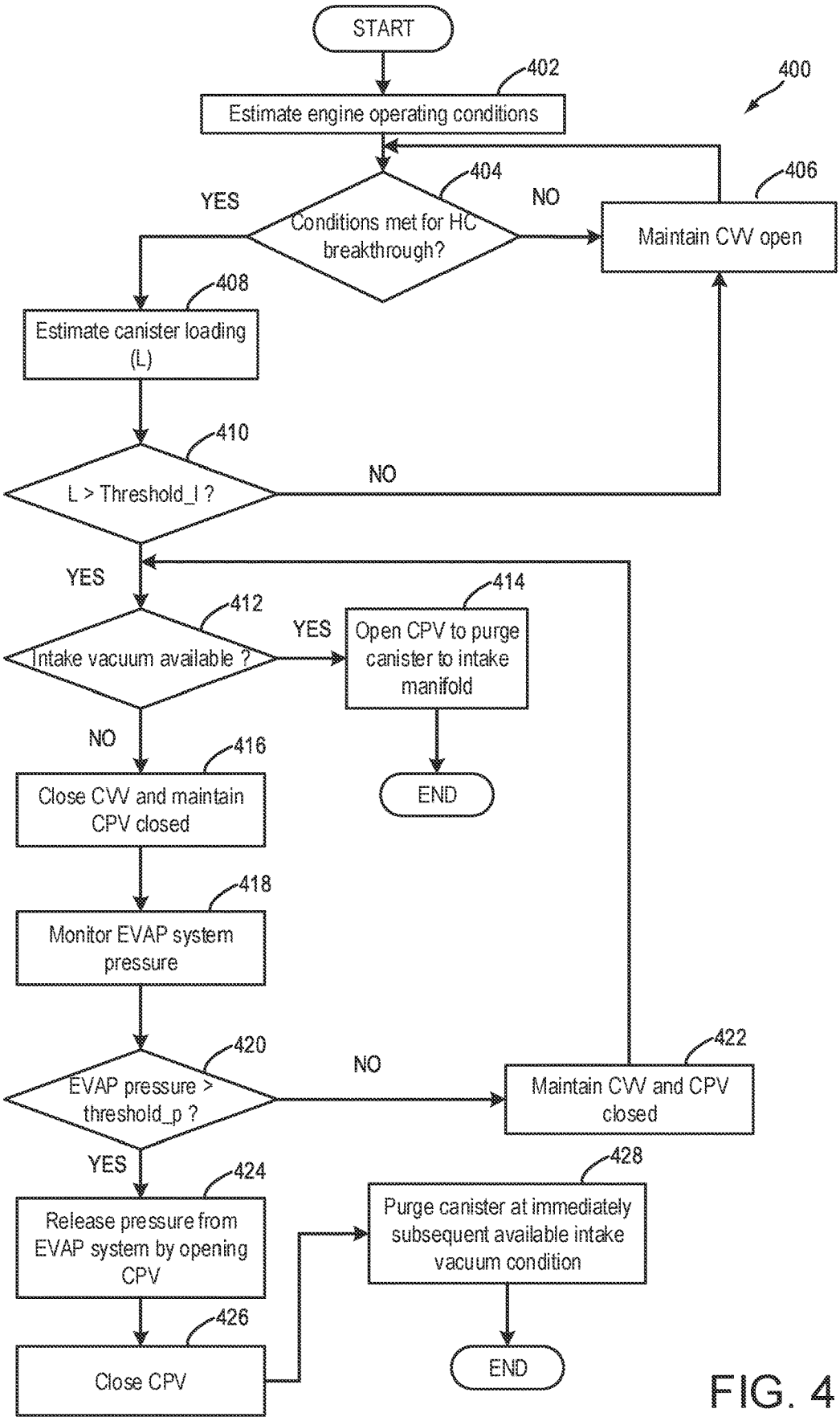
FIG. 4 shows a second flow-chart of a method for reducing the possibility of HC release to atmosphere during the drive cycle.
Figure 5:
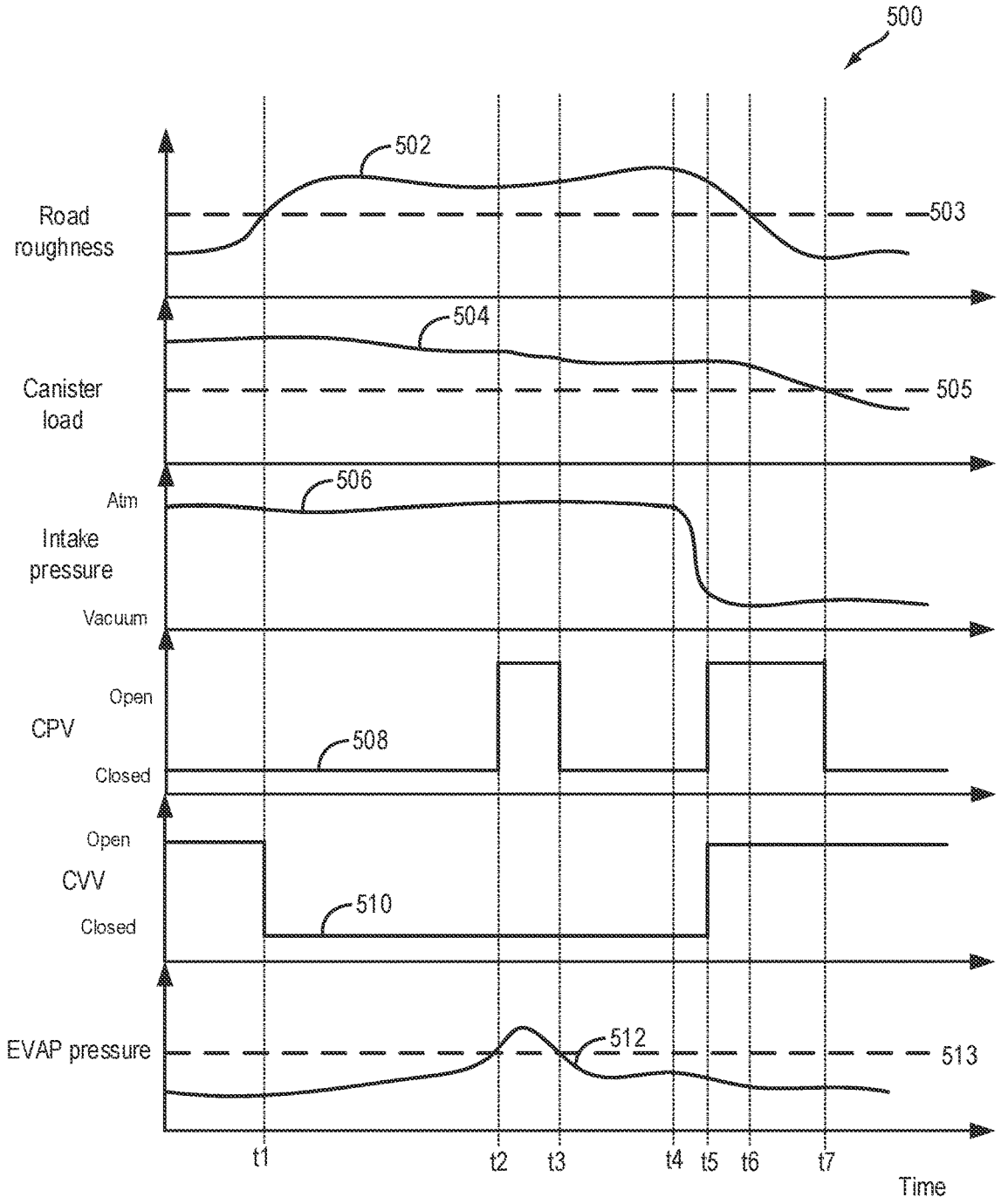
FIG. 5 shows an example timeline for operating the EVAP system to reduce the possibility of HC release to atmosphere during the drive cycle.

The following description relates to systems and methods for reducing a possibility of possibility of hydrocarbon (HC) release to atmosphere from an evaporative emissions control (EVAP) system of a vehicle. The EVAP system may be included in a hybrid vehicle system, such as the hybrid vehicle system shown in FIG. 1. The components of the EVAP system and the fuel system are elaborated in FIG. 2. The engine system may include a controller configured to carry out routines, such as shown in FIGS. 3-4, to estimate a roughness of the road travelled on by the vehicle during a drive cycle, and adjust operation of the EVAP system to prevent HC release to the atmosphere. An example operation of the EVAP system during potential HC breakthrough conditions is shown in the timeline of FIG. 5.

Figure 1:
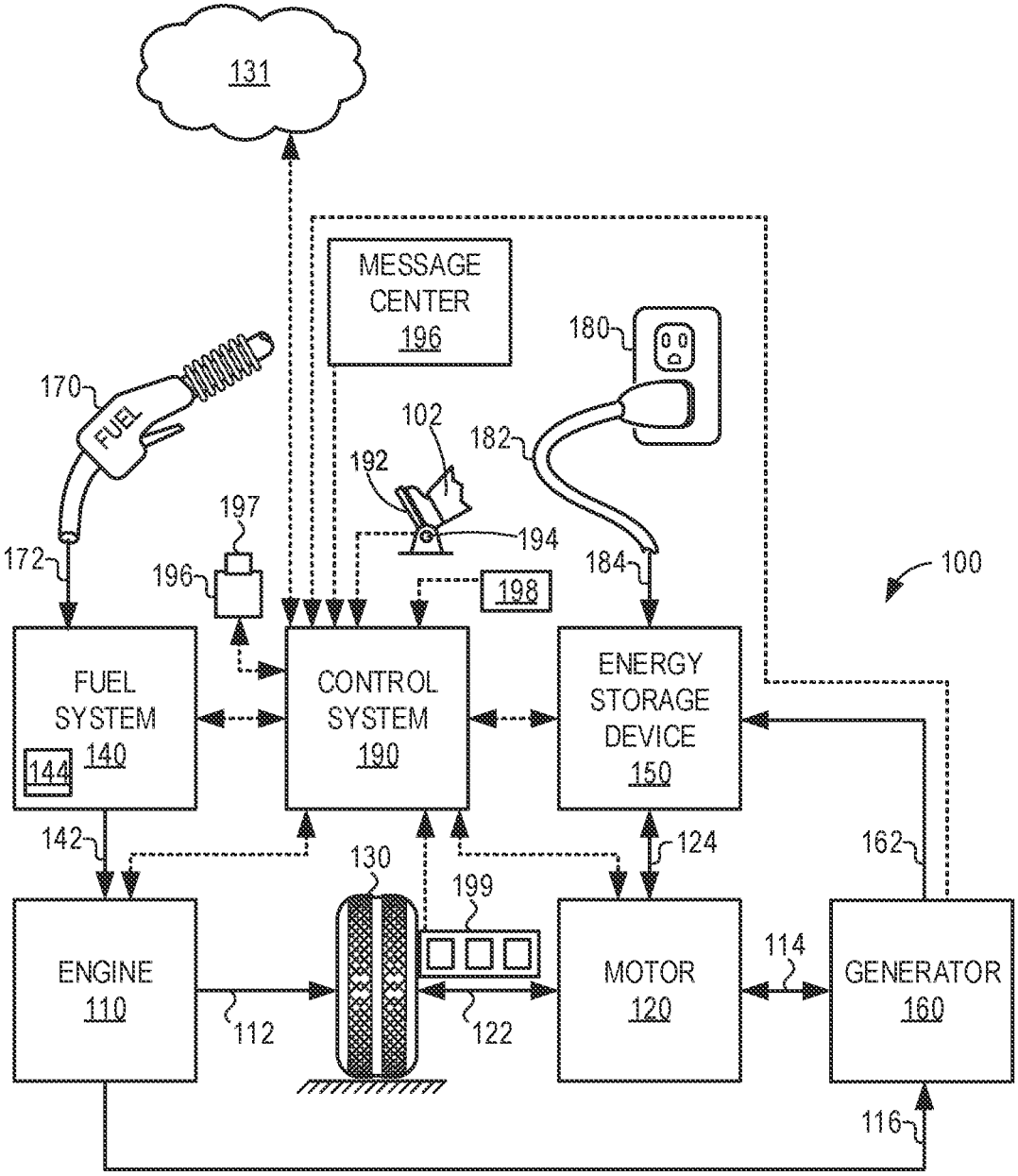
FIG. 1 schematically shows an example vehicle propulsion system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with vehicle propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical energy transmission cable 182 may electrically couple energy storage device 150 and power source 180. While the vehicle propulsion system is operated to propel the vehicle, electrical energy transmission cable 182 may be disconnected between power source 180 and energy storage device 150. Control system 190 may identify and/or control the amount of electrical energy stored at the energy storage device, which may be referred to as the state of charge (SOC).

In other embodiments, electrical energy transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor, wheel speed sensor, a crankshaft acceleration sensor, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Control system 190 may be communicably coupled to other vehicles or infrastructures using appropriate communications technology. For example, control system 190 may be coupled to other vehicles or infrastructures via wireless network 131, which may comprise Wi-Fi, Bluetooth®, a type of cellular service, a wireless data transfer protocol, and so on. Control system 190 may broadcast (and receive) information regarding vehicle data, vehicle diagnostics, traffic conditions, vehicle location information, road conditions, vehicle operating procedures, etc., via vehicle-to-vehicle (V2V), vehicle-to-infrastructure-to-vehicle (V2I2V), and/or vehicle-to-infrastructure (V2I or V2X) technology. The communication and the information exchanged between vehicles may either be direct between vehicles, or multi-hop. In some examples, longer range communications (e.g., WiMax) may be used in place of, or in conjunction with, V2V or V2I2V to extend coverage area on an order of a few miles. In still other examples, control system 190 may be communicably coupled to other vehicles or infrastructures via wireless network 131 and the Internet (e.g., cloud). In further examples, wireless network 131 may be a plurality of wireless networks 131 across which data may be communicated to vehicle propulsion system 101. Vehicle propulsion system 101 may also include an onboard navigation system 198 (for example, a global positioning system, or GPS) with which vehicle operator 102 may interact. Onboard navigation system 198 may include one or more location sensors for assisting in estimating vehicle speed, vehicle altitude, vehicle position/location, etc. and also information regarding terrain such as roughness and elevation of road. Such information may be used to infer vehicle operating parameters, such as road roughness, fuel sloshing, and local barometric pressure. In some examples, vehicle propulsion system may include laser sensors (e.g., lidar sensors), radar sensors, sonar sensors, and/or acoustic sensors, which may enable vehicle location information, traffic information, etc., to be collected via the vehicle.

Figure 2:
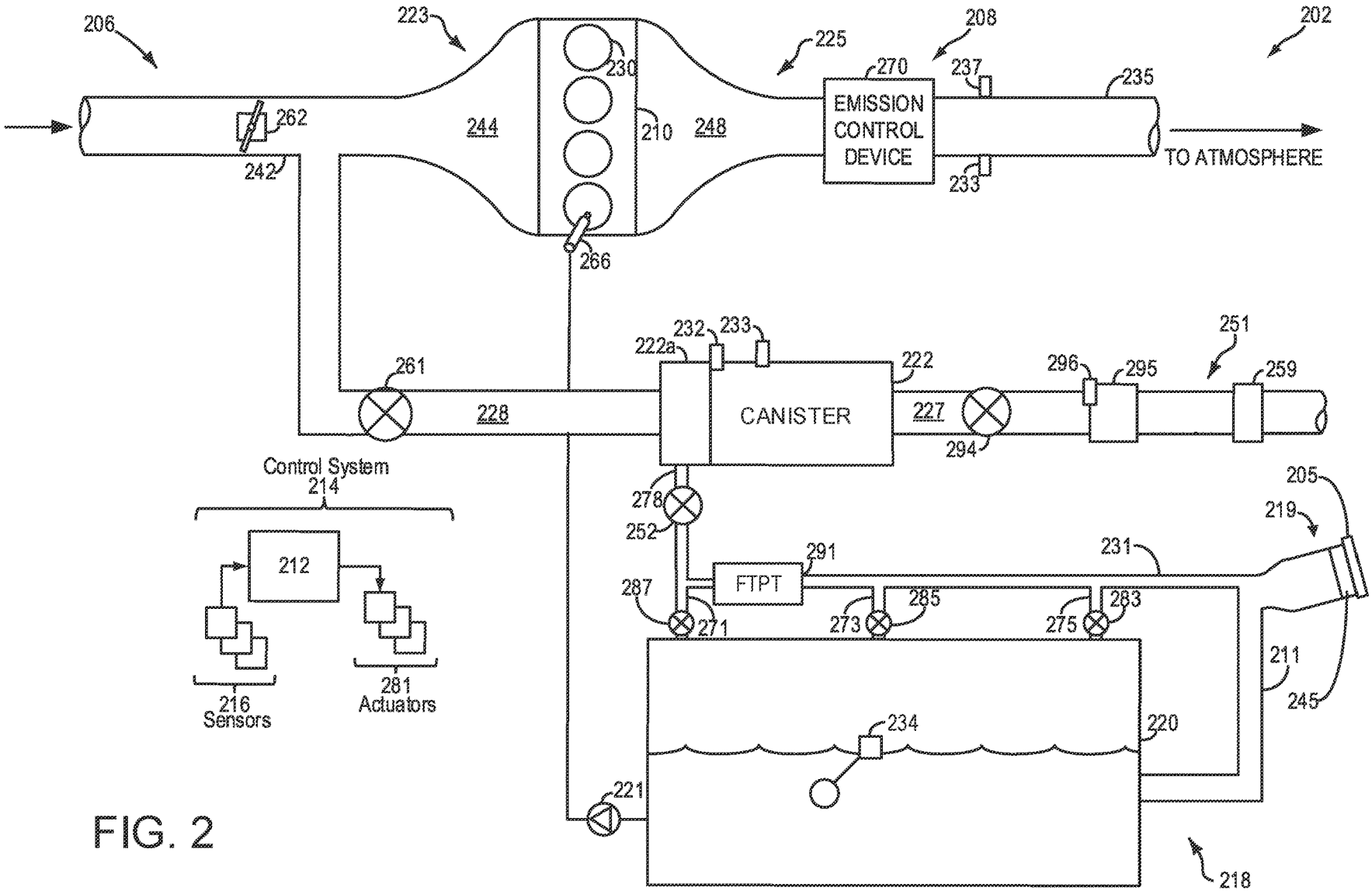
FIG. 2 schematically shows an example vehicle system with a fuel system and an evaporative emissions (EVAP) system operating.

Vehicle propulsion system 100 may be coupled within a vehicle system, such as vehicle system 206, as depicted as a schematic 202 in FIG. 2. The vehicle system 206 includes an engine system 208 coupled to an evaporative emissions control (EVAP) system 251 and a fuel system 218. Emission control system 251 includes a fuel vapor container or canister 222 which may be used to capture and store fuel vapors. In some examples, vehicle system 206 may be a hybrid electric vehicle system, including a motor, generator, energy storage device, etc., as shown for vehicle propulsion system 100.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

One or more of the intake and exhaust valves of the engine cylinders 230 may be actuated by one or more cams, and may utilize one or more of cam profile switching (CPS), variable cam timing (VCT), variable valve timing (VVT) and/or variable valve lift (VVL) systems to vary valve operation. For example, cylinders 230 may alternatively include an intake valve controlled via electric valve actuation and an exhaust valve controlled via cam actuation including variable cam timing (VCT).

The VCT may be a twin independent variable camshaft timing system, for changing intake valve timing and exhaust valve timing independently of each other. Further, the VCT may be configured to advance or retard valve timing by advancing or retarding cam timing and may be controlled by controller 212. Further, the VCT may be configured to vary the timing of valve opening and closing events by varying the relationship between the crankshaft position and the camshaft position. For example, VCT may be configured to rotate intake camshaft independently of the crankshaft to cause the valve timing to be advanced or retarded. In some embodiments, VCT may be a cam torque actuated device configured to rapidly vary the cam timing. In some embodiments, valve timing such as intake valve closing (IVC) and exhaust valve closing (EVC) may be varied by a continuously variable valve lift (CVVL) device.

The valve/cam control devices and systems described above may be hydraulically powered, or electrically actuated, or combinations thereof. In one example, a position of the camshaft may be changed via cam phase adjustment of an electrical actuator (e.g., an electrically actuated cam phaser). In another example, the camshaft position may be changed via a hydraulically operated cam phaser. Signal lines may send control signals to and receive a cam timing and/or cam selection measurement from the VCT. By adjusting the variable cam timing, a volumetric efficiency of the engine may be varied. During operation of the engine with adjusted cam timing, pumping losses may be reduced and at lower torque demand conditions (part throttle), the engine maybe operated without intake manifold vacuum (such as intake manifold being at or close to atmospheric pressure).

Fuel system 218 may include a fuel tank 220 coupled to a fuel pump system 221. The fuel pump system 221 may include one or more pumps for pressurizing fuel delivered to the injectors of engine 210, such as the example fuel injector 266 shown. While only a single fuel injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, there may be one or more fuel tank vent valves in conduits 271, 273, or 275. Among other functions, fuel tank vent valves may allow a fuel vapor canister of the emissions control system 251 to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, vapor recovery line 231 may be coupled to a fuel filler system 219. In some examples, fuel filler system may include a fuel cap 205 for sealing off the fuel filler system from the atmosphere. Refueling fuel filler system 219 is coupled to fuel tank 220 via a fuel filler pipe or neck 211.

Further, refueling fuel filler system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank 220 is greater than a threshold. In response to a refuel request, e.g., a vehicle operator initiated request, the fuel tank 220 may be depressurized and the fuel cap 205 unlocked after the pressure or vacuum in the fuel tank falls below a threshold. A fuel cap locking mechanism may be a latch or clutch, which, when engaged, prevents the removal of the fuel cap 205. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

Emissions control system 251 may include one or more emissions control devices, such as one or more fuel vapor canisters 222 filled with an appropriate adsorbent. The canisters 222 are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region) at a first end of the canister, each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. A temperature sensor 232 and a pressure sensor 233 may be coupled to the canister. As fuel vapor is adsorbed by the adsorbent in the canister 222, heat is generated (heat of adsorption). Likewise, as fuel vapor is desorbed by the adsorbent in the canister 222, heat is consumed. In this way, the adsorption and desorption of fuel vapor by the canister 222 and migration of HCs within the canister may be monitored and estimated based on temperature changes within the canister.

Vent line 227 may also allow fresh air to be drawn into canister 222 when purging stored fuel vapors from fuel system 218 to engine intake 223 via purge line 228 and canister purge valve (CPV) 261. For example, canister purge valve 261 may be normally closed but may be opened during certain conditions so that vacuum from engine intake manifold 244 is provided to the fuel vapor canister 222 for purging. In some examples, vent line 227 may include an air filter 259 disposed therein upstream of a canister 222.

In some examples, the flow of air and vapors between canister 222 and the atmosphere may be regulated by a canister vent valve (CVV) 294 coupled within vent line 227. The CVV 294 may be a normally open valve, so that fuel tank isolation valve 252 (FTIV) may control venting of fuel tank 220 with the atmosphere. FTIV 252 may be positioned between the fuel tank and the fuel vapor canister within conduit 278. Conduit 278 may be fluidically coupled to vapor recovery line 231, and thus may be coupled to one or more of conduits 271, 273, and 275, either directly or indirectly. FTIV 252 may be a normally closed valve, that when opened, allows for the venting of fuel vapors from fuel tank 220 to canister 222. Fuel vapors may then be vented to atmosphere, or purged to engine intake 223 via canister purge valve 261.

Fuel system 218 may be operated by controller 212 in a plurality of modes by selective adjustment of the various valves and solenoids. For example, the fuel system 218 may be operated in a fuel vapor storage mode (e.g., during a fuel tank refueling operation and with the engine not running), wherein the controller 212 may open fuel tank isolation valve 252 while closing canister purge valve 261 to direct refueling vapors into canister 222 while preventing fuel vapors from being directed into the intake manifold 244.

As another example, the fuel system 218 may be operated in a refueling mode (e.g., when fuel tank refueling is requested by a vehicle operator), wherein the controller 212 may open fuel tank isolation valve 252, while maintaining canister purge valve 261 closed, to depressurize the fuel tank 220 before allowing enabling fuel to be added therein. As such, fuel tank isolation valve 252 may be kept open during the refueling operation to allow refueling vapors to be stored in the canister 222. After refueling is completed, the isolation valve 252 may be closed.

As yet another example, the fuel system 218 may be operated in a canister purging mode (e.g., after an emission control device light-off temperature has been attained and with the engine running), wherein the controller 212 may open canister purge valve 261 while closing fuel tank isolation valve 252. Herein, the vacuum generated at the intake manifold 244 during engine operation may be used to draw fresh air through vent line 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located downstream of the emission control device 270, temperature sensor 232, and, pressure sensors 233 and 291. Other sensors such as pressure, temperature, air/fuel ratio, and composition sensors may be coupled to various locations in the vehicle system 206. As another example, the actuators may include fuel injector 266, throttle 262, fuel tank isolation valve 252, CPV 261, CVV 294, and refueling lock 245. The control system 214 may include a controller 212. The controller 212 may receive input data from the various sensors, process the input data, and trigger the actuators in response to the processed input data based on instruction or code programmed therein corresponding to one or more routines. An example control routine is described herein with regard to FIG. 4.

Leak detection routines may be intermittently performed by controller 212 on fuel system 218 to confirm that the fuel system is not degraded. As such, leak detection routines may be performed while the engine 210 is off (engine-off leak test) using engine-off natural vacuum (EONV) generated due to a change in temperature and pressure at the fuel tank 220 following engine shutdown and/or with vacuum supplemented from a vacuum pump. Alternatively, leak detection routines may be performed while the engine 210 is running by operating a vacuum pump and/or using engine intake manifold vacuum. Leak tests may be performed by an evaporative leak check module (ELCM) 295 communicatively coupled to controller 212. ELCM 295 may be coupled in vent line 227, between canister 222 and the atmosphere. ELCM 295 may include a vacuum pump for applying negative pressure to the fuel system 218 when administering a leak test. In some embodiments, the vacuum pump may be configured to be reversible. In other words, the vacuum pump may be configured to apply either a negative pressure or a positive pressure on the fuel system 218. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, a fuel system leak may be diagnosed.

During certain vehicle operating conditions, there may be an increase in possibility of HC breakthrough from the canister 222, such as due to desorption of HCs previously adsorbed at the canister, or due to increase in ambient temperature, which results in higher volatilization of liquid fuel in the fuel tank 220, which may be routed to the canister by opening the FTIV 252. During conditions when the vehicle is operating under off-road conditions on high roughness road, the vibration caused may cause the HCs to desorb from the canister 222. Conditions for potential hydrocarbon breakthrough from the canister 222 include a roughness index of a road on which the vehicle is travelling being higher than a threshold roughness index, and a HC load in the canister being higher than a threshold load. The roughness index of the road may be estimated based on one or more of a wheel speed, a wheel slippage, an angular velocity, a slip-angle, a crankshaft acceleration, steering movements, and an input from a navigation system. The conditions for potential hydrocarbon breakthrough may also include exposure of the canister 222 to a higher than threshold ambient temperature for a longer than threshold duration.

In response to the conditions being met for HC breakthrough while a pressure at the intake manifold 244 is lower than a first threshold pressure (intake manifold vacuum), the canister 222 may be purged to the intake manifold by opening the CPV 261 housed in a purge line 228 connecting the canister to the intake manifold, and opening CVV 294 housed in a purge line connecting the canister to atmosphere. In response to conditions being met for the potential HC breakthrough from the fuel vapor canister 222 during the intake manifold 244 being substantially at an atmospheric pressure, the canister may be isolated from atmosphere and the intake manifold of the engine 210. Isolating the canister includes closing the CVV 294 while maintaining the CPV 261 and the FTIV 252 in their respective closed positions. During isolation of the canister 222, in response to an EVAP system pressure increasing to above a second threshold pressure, the EVAP system pressure may be released by opening the CPV 261 while maintaining the CVV 294 and the FTIV 252 in their respective closed positions, the second threshold pressure higher than the first threshold pressure. Upon completion of the release of the EVAP system pressure, the CPV 261 may be closed, the completion of the release of the EVAP system pressure indicated by a decrease in the EVAP system pressure to below the second threshold pressure. During isolation of the canister, in response to the pressure at the intake manifold 244 decreasing to below the first threshold pressure, each of the CPV 261 and the CVV 294 may be opened to purge the canister 222 to the intake manifold 244.

In this way, the components described in FIGS. 1-2 enable a system for an evaporative emissions control (EVAP) system 251 of an engine in a vehicle, comprising: a controller 212 storing instructions in non-transitory memory that, when executed, cause the controller to: monitor a hydrocarbon (HC) loading in a fuel vapor canister 222 of the EVAP system 251, monitor a roughness index of a road segment being travelled by the vehicle 206, and in response to a higher than threshold roughness index and a higher than threshold HC loading, isolate the fuel vapor canister from each of a fuel tank 218, atmosphere, and an engine intake manifold 244.

FIG. 3 shows a flow chart for a high-level method 300 for determining roughness of a road on which a vehicle is operating during a drive cycle. Instructions for carrying out method 300 and other methods included herein may be executed by a controller (e.g. controller 212 of FIG. 2) based on instructions stored in a non-transitory memory of the controller and in conjunction with signals received from sensors of the engine system, such as the sensors described above with reference to FIGS. 1-2. The controller may employ engine actuators of the engine system to adjust engine operation, according to the methods described below. Method 300 will be described with regards to the systems described herein and depicted in FIGS. 1-2, but it should be understood that similar methods may be applied to other systems without departing from the scope of this disclosure.

At 302, wheel speed of the vehicle may be estimated via a wheel speed sensor. A change in wheel speed over distance and time may be estimated to determine the variation in wheel speed. Wheel slippage may also be estimated as a function of wheel speed. At 304, yaw rate of the vehicle may be estimated via a yaw rate sensor (e.g. yaw rate sensor(s) 199 of FIG. 1). Angular velocity and slip-angle of the vehicle may be estimated from the output of the yaw rate sensor. Further, steering movements of the vehicle may be determined via a steering wheel sensor. At 306, crankshaft acceleration may be estimated via a crankshaft acceleration sensor coupled to the crankshaft of the engine.

At 308, conditions of road on which the vehicle is travelling may be obtained via an on-board navigation system. In one example, the controller on-board the vehicle may include a navigation system (e.g., global positioning system, GPS) via which a location of the vehicle (e.g., GPS co-ordinates of the vehicle) may be transmitted to an external server over a network. Based on the location of the vehicle, local road conditions for that location may be retrieved from the external server. Further still, the navigation system may be used to plan a vehicle route of travel and based on the planned route, road conditions for the entirely of the route may be retrieved. This may include receiving an estimate of regions of the planned route where the expected road roughness is higher (e.g., road roughness index is higher) and regions of the planned route where the expected road roughness is lower (e.g., road roughness index is lower).

In another example, the on-board vehicle controller may be communicatively coupled to the on-board controller of one or more other vehicles, such as using vehicle to vehicle (V2V) communication technology. The one or more other vehicles may include other vehicles within a threshold radius of the given vehicle and having the same make or model. Road conditions may be retrieved from one or more vehicles within a threshold radius of the given vehicle.

At 310, road roughness conditions of the road segment on which the vehicle is travelling may be estimated as a function of one or more of wheel speed, wheel slippage, angular velocity, slip-angle, crankshaft acceleration, and steering movements. Further, the road roughness may be estimated based on the road conditions retrieved from the navigation system or from an external source. For example, a statistical or weighted average of the values retrieved from one or more vehicles may be used to estimate the road roughness conditions. A road roughness index may be computed based on the road roughness condition.

FIG. 4 shows a flow chart for a high-level method 400 for reducing the possibility of HC release to atmosphere during a drive cycle of a vehicle (such as vehicle system 206 of FIG. 2). Method 400 begins at 402 by estimating engine and vehicle operating conditions. The operating conditions may include engine operating status (engine load, engine temperature, engine speed), fuel level, fuel tank pressure, etc. For an engine equipped with VCT, a state of operation of the VCT and a variable cam timing may be determined. It may be determined if the vehicle is being operated solely via motor torque with the engine inactive. Operating conditions may also include ambient conditions, such as temperature, humidity, and barometric pressure, etc.

At 404, the routine includes determining if conditions are met for a potential HC breakthrough from a fuel vapor canister (such as canister 222 in FIG. 2) of an EVAP system (such as EVAP system 251 of FIG. 2). Conditions for HC breakthrough may include, a higher than threshold road roughness condition of the road segment being travelled on such that during travel on the road segment, vibration may cause HCs previously adsorbed in the canister to be desorbed (due to weak Van Der Waals forces bonding the HCs to the absorbent) and released to a vent line (such as vent line 227 of FIG. 2). Further, vibrations on a rough road may increase fuel sloshing and vitalization of fuel. The road roughness of the road segment may be estimated via the method 300 in FIG. 3. The controller may determine if the road roughness index is higher than a predetermined threshold. In one example, it may be determined that the road roughness index is higher than the threshold when a change in steering angle is higher than a threshold angle, when a yawing rate is higher than a threshold rate, when wheel speed is higher than a threshold speed and/or when crankshaft acceleration is higher than a threshold acceleration.

The conditions for a potential HC break may also include high temperature conditions and prolonged direct exposure to sun. During such conditions, HCs may also be desorbed to the canister. Also, heat may increase vaporization of liquid fuel in a fuel tank (e.g. 218 of FIG. 2) and a fuel vapor line which may be routed to the canister by opening the fuel tank isolation valve (e.g. 252 of FIG. 2) and if the canister loading is high, some of the fuel vapor may breakthrough to the vent line. The possibility of increased fuel vaporization and consequent HC breakthrough may be higher for the fuel tank housing a large amount of fuel such as close to the fuel tank limit.

If it is determined that any of the conditions for a potential HC breakthrough are not met, at 406, a canister vent valve (such as CVV 294 in FIG. 2) housed in the vent line may be maintained in its default open position to allow fluidic communication between the canister and atmosphere. A canister purge valve (such as CPV 261 in FIG. 2) housed in a purge line connecting the canister to engine intake manifold may be maintained in the default closed position.

If it is determined that even one condition is met for a potential HC breakthrough, at 408, a HC load (L) in the canister may be estimated. A level of loading of the fuel vapor canister of the EVAP system may be estimated based on output of an exhaust oxygen sensor, canister temperature sensor (such as temperature sensor 232 in FIG. 2), and a purging schedule of the canister. The purging schedule may include a time since last purge event. The canister load may be further estimated based on a number of refueling events (if any) after the last purge event.

At 410, the routine includes determining if the estimated canister load is higher than a threshold load. The threshold load may be pre-calibrated for current weather conditions such that a HC load above the threshold load may lead to reabsorption of HCs within the canister. As an example, the controller may use a look-up table to determine the threshold load corresponding to current ambient temperature. If it is determined that the estimated canister load is lower than the threshold load, it may be inferred that even though one or more conditions are present for possible HC breakthrough, due to the low canister load, actual HC breakthrough may not occur. The routine may then return to step 406 to maintain the CVV open and the CPV closed.

If it is determined that the estimated canister load is higher than the threshold load while one or more conditions are present for possible HC breakthrough, at 412, the routine includes determining if intake manifold vacuum is available. Intake manifold vacuum (pressure) level may be estimated via an intake air pressure sensor. During conditions when the vehicle is operated solely via motor torque and the engine is inactive, the intake manifold vacuum may not be available. Also, at certain settings of the VCT, the intake manifold may be at or close to atmospheric pressure. Engines may also deploy a modified Atkinson cycle by late closure of the intake valve during a compression stroke. By late closing (retard) of the intake valve during the compression stroke, a portion of the intake air is dumped back into the intake manifold instead of the exhaust manifold which may negate intake manifold vacuum. Normal closing of the intake valve results in vacuum in intake manifold. If the intake manifold is not at a lower pressure relative to atmospheric pressure, it may not be able to draw in fuel vapors from the EVAP system during a purging event when fluidic communication is established between the intake manifold and the purge line of the EVAP system.

If it is determined that intake manifold vacuum is available, at 414, the CPV may be actuated to an open position to purge the canister to the intake manifold. Upon opening the CPV, a fluidic communication is established between the engine intake manifold and the canister. Due to the lower pressure at the intake manifold, fresh air is drawn in from the atmosphere via the vent line and the open CVV to the intake manifold via the canister. As the fresh air flows in through the canister, HCs within the canister may be desorbed and drawn to the intake manifold and then combusted in the engine cylinders. In this way, the HC load of the canister and the EVAP system may be reduced to below the threshold load and possibility of HC breakthrough to the vent line and subsequent release of HC to the atmosphere may be reduced. The method may then end.

If it is determined that intake manifold vacuum is not available, it may be inferred that purging of the canister (to the intake manifold) to reduce HC load of the canister and the EVAP system may not be possible. At 416, the CVV may be actuated to a closed position while the CPV is maintained in the closed position. In vehicles including an ELCM system, the change-over valve of the ELCM may also be closed in place of the CVV. A fuel tank isolation valve (such as FTIV 252 in FIG. 2) may also be maintained in a closed position to isolate the fuel tank from the canister. In this way, the canister may be isolated from the atmosphere and the engine intake system. By isolating the canister and the vent line between the canister and the CVV from the atmosphere, any breakthrough of HC from the canister may be contained in the vent line and not released to the atmosphere. By isolating the canister from the fuel system further flow of HCs to the canister may be inhibited. Also, by maintaining the CPV closed, flow of breakthrough HC to the engine intake manifold in absence of a vacuum may be averted.

Due to the isolation of the canister from the atmosphere, the intake manifold, and the fuel system, the pressure within the EVAP system and in particular the canister may increase. At 418, the pressure increase in the EVAP system may be monitored via a pressure sensor coupled to the canister (such as pressure sensor 233 in FIG. 2). At 420, the routine includes determining if the pressure in the EVAP system including the canister has increased to a threshold pressure level (threshold_p). The threshold_p may be pre-calibrated based on structure of the canister. If the canister endures a pressure higher than threshold_p, structural integrity of the canister may be compromised and wear of EVAP system may increase. In one example. threshold_p may be in a range of 7-9 in$H_2O$.

If it is determined that the pressure in the EVAP system including the canister is below threshold_p, the isolation of the canister may be continued. At 422, the CVV and the CPV may be maintained in their respective closed positions. If it is determined that the pressure in the EVAP system including the canister has increased to or above the threshold_p, at 424, pressure from the EVAP system may be released by opening the CPV while maintaining the CVV closed. Upon opening the CPV, a part of the fuel vapor may flow to the intake manifold, while another part of the fuel vapor may be adsorbed back to the canister. By releasing the pressure, EVAP system and fuel system components may be protected from excess pressure. Once the pressure is released and the EVAP system pressure reduces to close to the atmospheric pressure, at 426, the CPV is closed again to isolate the canister. In this way, any HC breakthrough from the canister is contained from being released to the atmosphere while preventing any mechanical wear on EVAP system components due to increased pressure.

At 428, the canister may be purged to the engine intake manifold at an immediately subsequent available intake vacuum condition. The intake pressure may be continued to be monitored and in response to the intake manifold vacuum being generated, such as due to adjustment in vehicle operation (switching from fully driven by machine torque to at least partially driven by engine torque) or adjustment to VCT settings, and a purge of the canister may be initiated.

The purge may include, opening each of the CVV and the CPV to route fresh air from the atmosphere to the intake manifold, the fresh air drawing out fuel vapors from the canister, the vent line, and the purge line to the intake manifold. The fuel vapor may then be combusted in the engine cylinders.

In this way, during a first condition, hydrocarbons (HCs) from a fuel vapor canister of an evaporative emissions control (EVAP) system may be purged to an engine intake manifold by opening a canister purge valve (CPV) and a canister vent valve (CVV), and during a second condition, the fuel vapor canister may be isolated from atmosphere and the engine intake manifold by closing each of the CPV and the CVV. The first condition includes the intake manifold operating at a lower than threshold pressure, and the second condition includes the intake manifold operating at an atmospheric pressure. During each of the first condition and the second condition, a load of HCs in the fuel vapor canister may be above a threshold load, and a roughness index of a road on which the vehicle is travelling may be higher than a threshold roughness index.

FIG. 5 shows an example operating sequence 500 to reduce the possibility of HC release to atmosphere from fuel vapor canister (such as fuel vapor canister 222 in FIG. 2A) of an evaporative emissions control (such as emissions EVAP system 251 in FIG. 2A) system in a vehicle (such as vehicle system 206 of FIG. 2) during a drive cycle. The horizontal (x-axis) denotes time and the vertical markers t1-t7 identify significant times in the vehicle operation. The first plot, line 502, denotes roughness of the road surface on which the vehicle is operating. The road roughness is estimated as a function of one or more of a wheel speed, a wheel slippage, an angular velocity, a slip-angle, a crankshaft acceleration, and steering movements. Further rough roughness can be estimated based on road conditions data received from a navigational system or an external device. Dashed line 503 denotes a pre-calibrated threshold road roughness above which HCs from the canister may be desorbed and released to a vent line (such as vent line 227 of FIG. 2). The second plot, line 504, denotes a HC load in the fuel vapor canister as estimated via one or more of an output of a canister temperature sensor, an output of an exhaust oxygen sensor, and a purge schedule of the canister. Dashed line 505 denotes a pre-calibrated threshold of HC loading in the canister, above which possibility of HC breakthrough from the canister increases. The third plot, line 506, denotes a pressure in an intake manifold (such as intake manifold 244 of FIG. 2) of an engine (such as engine 210 of FIG. 2), as estimated via a manifold air pressure sensor. The fourth plot, line 508, denotes a position of a canister purge valve (such as CPV 261 in FIG. 2) housed in a purge line (such as purge line 228 of FIG. 2) connecting the canister to the intake manifold. The fifth plot, line 510, denotes a position of a canister vent valve (such as CVV 294 in FIG. 2) housed in the vent line. The sixth plot line 512, denotes a pressure in the EVAP system as estimated via a pressure sensor coupled to the fuel vapor canister. Dashed line 513 denotes a pre-calibrated pressure threshold above which a release in pressure from the EVAP system is desired to maintain integrity of the EVAP system components.

Prior to time t1, the vehicle is operated on a terrain with a lower than threshold 503 road roughness, with the intake pressure in the engine close to atmospheric pressure (intake manifold vacuum absent). The canister load is higher than the threshold load 505 indicating the possibility of a HC breakthrough to the vent line in presence of a trigger condition. The CPV is maintained closed to disable purging of the canister in absence of the intake vacuum. The CVV is in open position to allow flow of fresh air to flow into EVAP system via the vent line. As the EVAP system is vented to atmosphere, the pressure of the EVAP system remains below the threshold pressure 513.

At time t1, in response to an increase in road roughness to above the threshold roughness 503, a trigger is available for HC breakthrough from the higher than threshold loaded canister to the vent line. The vibration caused during travel on the rough road facilitates breaking of the weak Van Der Waals bonds of the HCs with the canister substrate, thereby releasing HCs to the vent line. In order to prevent the HCs from being released to the atmosphere, the CVV is actuated to a closed position. Due to the CPV being maintained closed, the canister is now isolated from the atmosphere and the engine intake manifold. Due to the isolation of the canister, between time t1 and t2, the EVAP system pressure increases.

At time t2, it is observed that the EVAP system pressure has increased to the threshold pressure 513, and in order to release the pressure, the CPV is actuated to the open position while maintain CVV closed. Due to the change in pressure, the released HCs may be forced to be reabsorbed by the canister or routed to the intake manifold, thereby resulting in a decrease in EVAP system pressure.

At time t3, upon release of the EVAP system pressure, the canister is re-sealed by actuating the CPV to the closed position. At time t4, due to change in vehicle operation conditions such as a change VCT settings, the intake pressure starts decreasing. At time t5, it is inferred that the intake pressure has reduced to a vacuum level, and the canister can now be effectively purged to the intake manifold. Therefore, at time t5, each of the CVV and the CPV is actuated to their open positions to allow fresh air to be drawn to the intake manifold from atmosphere. Due to the intake vacuum, air flows from the atmosphere to the intake manifold via the vent line and the canister, drawing out all the HCs from the canister and also the breakthrough HCs to the intake manifold. In this way, even during rough road conditions, the canister can be opportunistically purged to reduce HC load in the canister and remove any breakthrough HCs to the intake manifold without being released to the atmosphere.

Between time t5 and t6, the purging is continued and the canister load steadily decreases. While the canister is being purged, as the vehicle moves along the route, at time t6, the road roughness decreases and possibility of HC breakthrough due to vibration further decreases. At time t7, upon completion of purging and the canister load decreasing to below the threshold load 505, the CPV is actuated to the closed position while the CVV is maintained in the default open position.

In this way, by monitoring conditions such as road roughness that may trigger HC breakthrough from a fuel vapor canister, and adjusting EVAP system valves upon detection of such conditions, release of HCs to atmosphere may be prevented. The technical effect of opportunistically closing the CVV during conditions that may trigger HC breakthrough is that the HCs released from the canister may be contained within the EVAP system and not released to the atmosphere. Overall, by effectively reducing the possibility of HC release to the atmosphere during all vehicle operating conditions, emissions quality may be maintained above desired levels An example method for an engine in a vehicle comprises: in response to conditions being met for a potential hydrocarbon (HC) breakthrough from a fuel vapor canister of an evaporative emissions control (EVAP) system, isolating the canister from atmosphere and an intake manifold of the engine In any of the preceding examples, additionally or optionally, the conditions for the potential hydrocarbon breakthrough include a roughness index of a road on which the vehicle is travelling being higher than a threshold roughness index, and a HC load in the canister being higher than a threshold load. In any or all of the preceding examples, additionally or optionally, the roughness index of the road is estimated based on one or more of a wheel speed, a wheel slippage, an angular velocity, a slip-angle, a crankshaft acceleration, steering movements, and an input from a navigation system. In any or all of the preceding examples, additionally or optionally, the conditions for potential hydrocarbon breakthrough include exposure of the canister to a higher than threshold ambient temperature for a longer than threshold duration. In any or all of the preceding examples, additionally or optionally, the isolating the canister is further in response to the intake manifold being substantially at an atmospheric pressure. Any or all of the preceding examples, the method further comprising, additionally or optionally, in response to the conditions being met for HC breakthrough while a pressure at the intake manifold is lower than a first threshold pressure, purging the canister to the intake manifold by opening a canister purge valve (CPV) housed in a purge line connecting the canister to the intake manifold, and opening a canister vent valve (CVV) connecting the canister to atmosphere. In any or all of the preceding examples, additionally or optionally, isolating the canister includes closing the CVV while maintaining the CPV and a fuel tank isolation valve (FTIV) in their respective closed positions. Any or all of the preceding examples, the method further comprising, additionally or optionally, during isolation of the canister, in response to an EVAP system pressure increasing to above a second threshold pressure, releasing the EVAP system pressure by opening the CPV while maintaining the CVV and the FTIV in their respective closed positions, the second threshold pressure higher than the first threshold pressure. Any or all of the preceding examples, the method further comprising, additionally or optionally, upon completion of the release of the EVAP system pressure, closing the CPV, the completion of the release of the EVAP system pressure indicated by a decrease in the EVAP system pressure to below the second threshold pressure. Any or all of the preceding examples, the method further comprising, additionally or optionally, during isolation of the canister, in response to the pressure at the intake manifold decreasing to below the first threshold pressure, opening each of the CPV and the CVV to purge the canister to the intake manifold.

Another example method for an engine in a vehicle, comprises: during a first condition, purge hydrocarbons (HCs) from a fuel vapor canister of an evaporative emissions control (EVAP) system to an engine intake manifold by opening a canister purge valve (CPV) and a canister vent valve (CVV), and during a second condition, isolate the fuel vapor canister from atmosphere and the engine intake manifold by closing each of the CPV and the CVV. In any of the preceding examples, additionally or optionally, during each of the first condition and the second condition, a load of HCs in the fuel vapor canister is above a threshold load and a roughness index of a road on which the vehicle is travelling is higher than a threshold roughness index. In any or all of the preceding examples, additionally or optionally, the roughness index of the road is estimated based on inputs from one or more of a wheel speed sensor, a yaw sensor, a crankshaft acceleration sensor, a steering movement sensor. In any or all of the preceding examples, additionally or optionally, the roughness index of the road is further estimated based on variation in elevation of the road as retrieved via one or more of a navigation system and a network cloud. In any or all of the preceding examples, additionally or optionally, the first condition includes the intake manifold operating at a lower than threshold pressure, and wherein the second condition includes the intake manifold operating at an atmospheric pressure. Any or all of the preceding examples, the method further comprising, additionally or optionally, during the isolation of the fuel vapor canister, monitoring a pressure of the canister, and in response to the pressure of the canister increasing to a threshold pressure, opening the CPV while maintaining the CVV closed. Any or all of the preceding examples, the method further comprising, additionally or optionally, upon release of the pressure of the canister, closing the CPV, and maintaining each of the CPV and the CVV closed until the intake manifold operates at the lower than threshold pressure.

Yet another example for an evaporative emissions control (EVAP) system of an engine in a vehicle, comprises: a controller storing instructions in non-transitory memory that, when executed, cause the controller to: monitor a hydrocarbon (HC) loading in a fuel vapor canister of the EVAP system, monitor a roughness index of a road segment being travelled by the vehicle, and in response to a higher than threshold roughness index and a higher than threshold HC loading, isolate the fuel vapor canister from each of a fuel tank, atmosphere, and an engine intake manifold. In any of the preceding examples, additionally or optionally, the isolating the fuel vapor canister includes closing each of a canister purge valve housed in a purge line connecting the fuel vapor canister and the intake manifold, a canister vent valve housed in a vent line connecting the fuel vapor canister to atmosphere, and a fuel tank isolation valve housed in a fuel vapor line connecting the fuel vapor canister to the fuel tank. In any or all of the preceding examples, additionally or optionally, the controller includes further instructions to: during isolation of the fuel vapor canister, monitor a pressure in the fuel vapor canister, and in response to the pressure in the fuel vapor canister increasing to a threshold pressure, open the CPV while maintaining the CVV and FTIV closed to release the pressure to the intake manifold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine in a vehicle, comprising:

in response to conditions being met for a potential hydrocarbon (HC) breakthrough from a fuel vapor canister of an evaporative emissions control (EVAP) system, isolating the canister from atmosphere and an intake manifold of the engine, wherein the conditions for the potential hydrocarbon breakthrough include a roughness index of a road on which the vehicle is traveling being higher than a threshold roughness index, and a HC load in the canister being higher than a threshold load.

2. The method of claim 1, wherein the roughness index of the road is estimated based on one or more of a wheel speed, a wheel slippage, an angular velocity, a slip-angle, a crankshaft acceleration, steering movements, and an input from a navigation system.

3. The method of claim 1, wherein the conditions for potential hydrocarbon breakthrough include exposure of the canister to a higher than threshold ambient temperature for a longer than threshold duration.

4. The method of claim 1, wherein the isolating the canister is further in response to the intake manifold being substantially at an atmospheric pressure.

5. The method of claim 1, further comprising, in response to the conditions being met for HC breakthrough while a pressure at the intake manifold is lower than a first threshold pressure, purging the canister to the intake manifold by opening a canister purge valve (CPV) housed in a purge line connecting the canister to the intake manifold, and opening a canister vent valve (CVV) connecting the canister to atmosphere.

6. The method of claim 5, wherein isolating the canister includes closing the CVV while maintaining the CPV and a fuel tank isolation valve (FTIV) in their respective closed positions.

7. The method of claim 6, further comprising, during isolation of the canister, in response to an EVAP system pressure increasing to above a second threshold pressure, releasing the EVAP system pressure by opening the CPV while maintaining the CVV and the FTIV in their respective closed positions, the second threshold pressure higher than the first threshold pressure.

8. The method of claim 7, further comprising, upon completion of the release of the EVAP system pressure, closing the CPV, the completion of the release of the EVAP system pressure indicated by a decrease in the EVAP system pressure to below the second threshold pressure.

9. The method of claim 5, further comprising, during isolation of the canister, in response to the pressure at the intake manifold decreasing to below the first threshold pressure, opening each of the CPV and the CVV to purge the canister to the intake manifold.

10. A method for an engine in a vehicle, comprising:

during a first condition, purge hydrocarbons (HCs) from a fuel vapor canister of an evaporative emissions control (EVAP) system to an engine intake manifold by opening a canister purge valve (CPV) and a canister vent valve (CVV); and during a second condition, isolate the fuel vapor canister from atmosphere and the engine intake manifold by closing each of the CPV and the CVV, wherein during each of the first condition and the second condition, a load of HCs in the fuel vapor canister is above a threshold load and a roughness index of a road on which the vehicle is travelling is higher than a threshold roughness index.

11. The method of claim 10, wherein the roughness index of the road is estimated based on inputs from one or more of a wheel speed sensor, a yaw sensor, a crankshaft acceleration sensor, a steering movement sensor.

12. The method of claim 10, wherein the roughness index of the road is further estimated based on variation in elevation of the road as retrieved via one or more of a navigation system and a network cloud.

13. The method of claim 10, wherein the first condition includes the intake manifold operating at a lower than threshold pressure, and wherein the second condition includes the intake manifold operating at an atmospheric pressure.

14. The method of claim 13, further comprising, during the isolation of the fuel vapor canister, monitoring a pressure of the canister, and in response to the pressure of the canister increasing to a threshold pressure, opening the CPV while maintaining the CVV closed.

15. The method of claim 14, further comprising, upon release of the pressure of the canister, closing the CPV, and maintaining each of the CPV and the CVV closed until the intake manifold operates at the lower than threshold pressure.

16. A system for an evaporative emissions control (EVAP) system of an engine in a vehicle, comprising:

a controller storing instructions in non-transitory memory that, when executed, cause the controller to:

monitor a hydrocarbon (HC) loading in a fuel vapor canister of the EVAP system;

monitor a roughness index of a road segment being travelled by the vehicle; and in response to a higher than threshold roughness index and a higher than threshold HC loading, isolate the fuel vapor canister from each of a fuel tank, atmosphere, and an engine intake manifold.

17. The system of claim 16, wherein the isolating the fuel vapor canister includes closing each of a canister purge valve housed in a purge line connecting the fuel vapor canister and the intake manifold, a canister vent valve housed in a vent line connecting the fuel vapor canister to atmosphere, and a fuel tank isolation valve housed in a fuel vapor line connecting the fuel vapor canister to the fuel tank.

18. The system of claim 16, wherein the controller includes further instructions to: during isolation of the fuel vapor canister, monitor a pressure in the fuel vapor canister, and in response to the pressure in the fuel vapor canister increasing to a threshold pressure, open the CPV while maintaining the CVV and FTIV closed to release the pressure to the intake manifold.

* * * * *